US009503814B2

(12) United States Patent
Schultz et al.

(10) Patent No.: US 9,503,814 B2
(45) Date of Patent: Nov. 22, 2016

(54) DIFFERENTIAL OUTPUTS IN MULTIPLE MOTOR MEMS DEVICES

(71) Applicant: Knowles Electronics, LLC, Itasca, IL (US)

(72) Inventors: Jordan T. Schultz, Chicago, IL (US); Weiwen Dai, Elgin, IL (US); Peter Van Kessel, Downers Grove, IL (US)

(73) Assignee: Knowles Electronics, LLC, Itasca, IL (US)

( * ) Notice: Subject to any disclaimer, the term of this patent is extended or adjusted under 35 U.S.C. 154(b) by 118 days.

(21) Appl. No.: 14/225,705

(22) Filed: Mar. 26, 2014

(65) Prior Publication Data

US 2014/0307885 A1 Oct. 16, 2014

Related U.S. Application Data

(60) Provisional application No. 61/810,387, filed on Apr. 10, 2013.

(51) Int. Cl.

| | |
|---|---|
| ***H04R 3/00*** | (2006.01) |
| ***H04R 19/04*** | (2006.01) |
| ***H04R 19/00*** | (2006.01) |

(52) U.S. Cl.

CPC ..... *H04R 3/005* (2013.01); *H04R 19/005* (2013.01); *H04R 19/04* (2013.01)

(58) Field of Classification Search

None

See application file for complete search history.

(56) References Cited

U.S. PATENT DOCUMENTS

| | | | |
|---|---|---|---|
| 5,822,598 | A | 10/1998 | Lam |
| 6,070,140 | A | 5/2000 | Tran |
| 6,154,721 | A | 11/2000 | Sonnic |
| 6,249,757 | B1 | 6/2001 | Cason |
| 6,397,186 | B1 | 5/2002 | Bush et al. |
| 6,756,700 | B2 | 6/2004 | Zeng |
| 7,190,038 | B2 | 3/2007 | Dehe et al. |

(Continued)

FOREIGN PATENT DOCUMENTS

| | | | |
|---|---|---|---|
| JP | 2003259476 | A | 9/2003 |
| JP | 2008005439 | A | 1/2008 |

OTHER PUBLICATIONS

International Search Report and Written Opinion for PCT/US2014/032851 dated Aug. 13, 2014, 10 pages.

*Primary Examiner* — Curtis Kuntz
*Assistant Examiner* — Kenny Truong
(74) *Attorney, Agent, or Firm* — Foley & Lardner LLP

(57) ABSTRACT

An the acoustic apparatus comprising a first MEMS motor that includes a first diaphragm and a first back plate, and a second MEMS motor that includes a second diaphragm and a second back plate. The first motor is biased with a first electrical polarity and a second motor is biased with a second electrical polarity such that the first electrical polarity and the second electrical polarity are opposite. At the first motor, a first signal is created that is representative of received sound energy. At the second motor, a second signal is created that is representative of the received sound energy. A differential output signal that is the representative of the difference between the first signal and the second signal is obtained. In obtaining the differential output signal, common mode noise between the first motor and the second motor is rejected.

13 Claims, 4 Drawing Sheets

(56) References Cited

U.S. PATENT DOCUMENTS

| | | | | |
|---|---|---|---|---|
| 7,415,416 | B2 | 8/2008 | Rees | |
| 7,473,572 | B2 | 1/2009 | Dehe et al. | |
| 7,774,204 | B2 | 8/2010 | Mozer et al. | |
| 7,781,249 | B2 | 8/2010 | Laming et al. | |
| 7,795,695 | B2 | 9/2010 | Weigold et al. | |
| 7,825,484 | B2 | 11/2010 | Martin et al. | |
| 7,829,961 | B2 | 11/2010 | Hsiao | |
| 7,856,804 | B2 | 12/2010 | Laming et al. | |
| 7,903,831 | B2 | 3/2011 | Song | |
| 7,957,972 | B2 | 6/2011 | Huang et al. | |
| 8,275,148 | B2 | 9/2012 | Li et al. | |
| 8,666,751 | B2 | 3/2014 | Murthi et al. | |
| 8,972,252 | B2 | 3/2015 | Hung et al. | |
| 8,996,381 | B2 | 3/2015 | Mozer et al. | |
| 9,043,211 | B2 | 5/2015 | Haiut et al. | |
| 9,112,984 | B2 | 8/2015 | Sejnoha et al. | |
| 2005/0207605 | A1 | 9/2005 | Dehe et al. | |
| 2006/0074658 | A1 | 4/2006 | Chadha | |
| 2007/0133820 | A1 | 6/2007 | Konchitsky | |
| 2007/0278501 | A1 | 12/2007 | Macpherson et al. | |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0136059 | A1* | 5/2009 | Inoda | H04R 1/406 381/92 |
| 2009/0152655 | A1 | 6/2009 | Laming et al. | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0098266 | A1* | 4/2010 | Mukund | G10L 21/0272 381/94.7 |
| 2010/0128914 | A1 | 5/2010 | Khenkin | |
| 2010/0177913 | A1 | 7/2010 | Chiu et al. | |
| 2010/0183181 | A1 | 7/2010 | Wang | |
| 2010/0246877 | A1 | 9/2010 | Wang et al. | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2012/0232896 | A1 | 9/2012 | Taleb et al. | |
| 2012/0269356 | A1* | 10/2012 | Sheerin | H04R 29/004 381/58 |
| 2012/0310641 | A1 | 12/2012 | Niemist et al. | |
| 2013/0223635 | A1 | 8/2013 | Singer et al. | |
| 2014/0122078 | A1 | 5/2014 | Joshi et al. | |
| 2014/0163978 | A1 | 6/2014 | Basye et al. | |
| 2014/0244269 | A1 | 8/2014 | Tokutake | |
| 2014/0257821 | A1 | 9/2014 | Adams et al. | |
| 2014/0270250 | A1* | 9/2014 | Muza | H04R 1/406 381/94.1 |
| 2014/0274203 | A1 | 9/2014 | Ganong et al. | |
| 2014/0278435 | A1 | 9/2014 | Ganong et al. | |
| 2014/0281628 | A1 | 9/2014 | Nigam et al. | |
| 2014/0343949 | A1 | 11/2014 | Huang et al. | |
| 2015/0106085 | A1 | 4/2015 | Lindahl | |
| 2015/0112690 | A1 | 4/2015 | Guha et al. | |
| 2015/0134331 | A1 | 5/2015 | Millet et al. | |

* cited by examiner

DIFFERENTIAL OUTPUTS IN MULTIPLE MOTOR MEMS DEVICES

CROSS REFERENCE TO RELATED APPLICATIONS

This patent claims benefit under 35 U.S.C. §119 (e) to U.S. Provisional Application No. 61/810,387 entitled "Differential Outputs in Multiple Motor MEMS Devices" filed Apr. 10, 2013, the content of which is incorporated herein by reference in its entirety.

TECHNICAL FIELD

This application relates to MEMS devices and, more specifically to MEMS devices that utilize differential amplifiers.

BACKGROUND OF THE INVENTION

Microelectromechanical System (MEMS) microphones have been used throughout the years. These devices include a back plate (or charge plate), a diaphragm, and other components. In operation, sound energy moves the diaphragm, which causes an electrical signal to be created at the output of the device and this signal represents the sound energy that has been received.

These microphones typically use amplifiers or other circuitry that further processes the signal obtained from the MEMS component. In some examples, a differential amplifier is used that obtains a difference signal from the MEMS device.

In these applications, the Signal-To-Noise ratio (SNR) is desired to be high since a high SNR signifies that less noise is present in the system. However, achieving a high SNR ratio is difficult to achieve. For example, different sources of noise are often present (e.g., power supply noise, RF noise, to mention two examples). In systems that use differential amplifiers, it is possible to reduce correlated (common mode) noise as well as increasing signal to noise ratio via the subtraction of the signals from the differential pair.

In previous systems, various attempts to negate noise in have generally been unsuccessful. As a result, user dissatisfaction with these previous systems has resulted.

BRIEF DESCRIPTION OF THE DRAWINGS

For a more complete understanding of the disclosure, reference should be made to the following detailed description and accompanying drawings wherein.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present approaches provide MEMS microphone arrangements that eliminate or substantially reduce common mode noise and/or other types of noise. By "common mode noise," it is meant noise that is common to both devices feeding the inputs of the differential stage. Common mode noise is unlike the intended signal generated by the devices because it is in phase between devices. The presented approaches may be provided on single or multiple substrates (e.g., integrated circuits) to suit a particular user or particular system requirements.

When these approaches are provided on a single substrate or integrated circuit, less elimination of common mode noise is typically provided, but this allows that the provision of an integrated amplifier and microphone assembly that it is more economical and user friendly than approaches are not provided on the single substrate or integrated circuit.

In some aspects, two MEMS devices are used together to provide differential signals. The charge plate of the one MEMS device may be disposed or situated on the top, the diaphragm on the bottom, and the charge plate supplied with a positive bias. Alternatively, the charge plate of the same MEMS device may be disposed on the bottom, the diaphragm disposed on the top, and the diaphragm supplied with a negative bias. These two arrangements will supply the same signal that is 180 degrees out of phase with a second MEMS device that has a diaphragm on the top, a charge plate on the bottom, and the diaphragm being positively biased.

As has been mentioned, the MEMS motors could be disposed on one substrate (e.g., an integrated circuit or chip) or on multiple substrates. "Bias" as used herein is defined as the electrical bias (positive or negative) of diaphragm with respect to the back plate. By "MEMS motor," it is meant a compliant diaphragm/backplate assembly operating under a fixed DC bias/charge.

Figure 1:
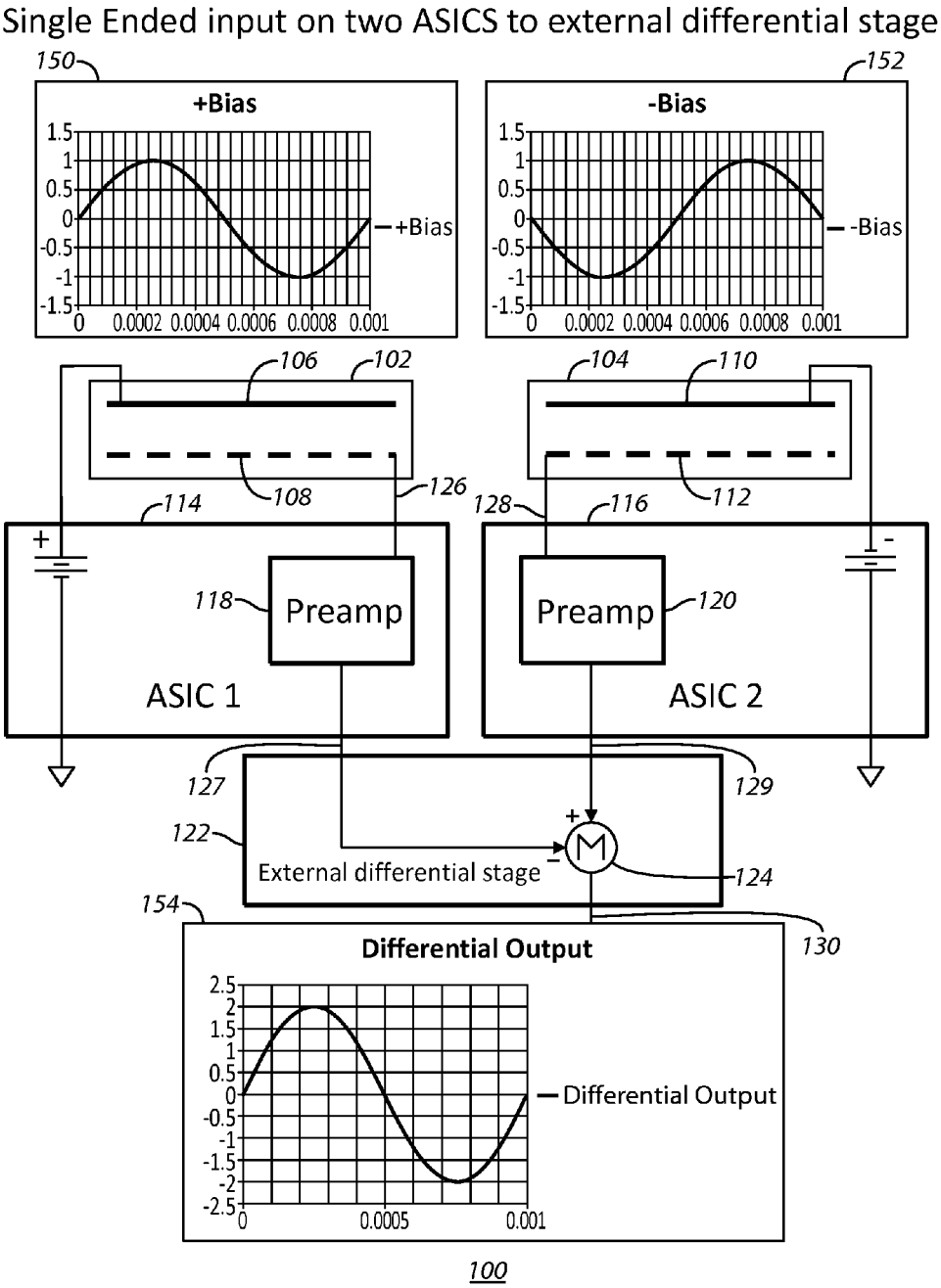
FIG. 1 comprises a block diagram of a system that has two single ended inputs on two chips to an external differential stage according to various embodiments of the present invention.

Referring now to FIG. 1, a system 100 includes a first MEMS device 102 (including a first diaphragm 106 and a first back or charge plate 108) and a second MEMS device 104 (including a second diaphragm 110 and a second back or charge plate 112). The diaphragms and charge plates mentioned herein are those that are used in typical MEMS devices as known to those skilled in the art and will be discussed no further detail herein.

The output of the MEMS devices 102 and 104 is supplied to a first integrated circuit 114 and a second integrated circuit 116. The integrated circuits, can in one example be application specific integrated circuits (ASICS). These circuits perform various processing functions such as amplification of the received signals.

The integrated circuits 114 and 116 include a first preamp circuit 118 and a second preamp circuit 120. The purpose of the preamp circuits 114 and 116 is to provide an extremely high impedance interface for a capacitive transducer which is generally high impedance source in the bandwidth of interest.

The outputs of the circuits 114 and 116 are transmitted to an external differential stage 122 (that includes a difference summer 124 that takes the difference of two signals from the circuits 114 and 116). In one example, the external differential stage 122 is either an integrated circuit on a microphone base PCB, or external hardware provided by the user.

A positive potential is supplied to first diaphragm 106 and a negative potential is applied to the second diaphragm 110. This creates a differential signal at leads 126 and 128 as illustrated in graphs 150 and 152. The differential signals in these graphs and as described elsewhere herein are out of phase by approximately 180 degrees with respect to each other. An output 130 of stage 122 is the difference between signals 127 and 129 and is shown in graph 154.

Common mode noise of the whole system is rejected by the stage 122. Common mode noise occurs between both of the MEMS motors and both ASICs in the example of FIG. 1. As can be seen in the graphs, an increased SNR is achieved at the output 130 and as mentioned, common mode noise is significantly reduced or eliminated. Both of these aspects provide for improved system performance. Common mode noise is significantly reduced or eliminated in the example of FIG. 1 because the common noise components are subtracted from one another. Because they have 0 degree phase difference, the differential amplifier will reject some or all of the common mode signal.

Figure 2:
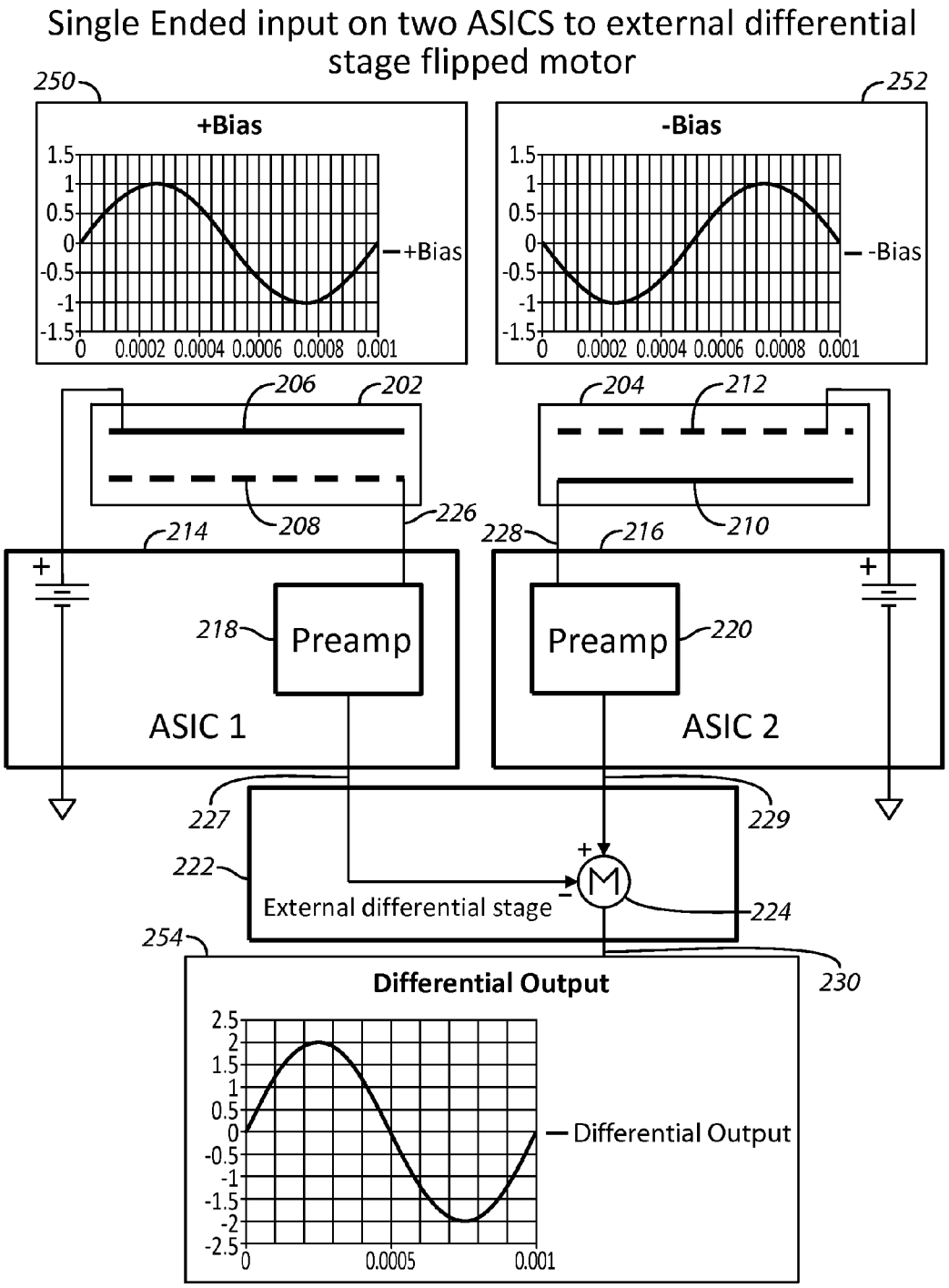
FIG. 2 comprises a block diagram of a system that has single ended inputs on two chips to an external differential flipped motor according to various embodiments of the present invention.

Referring now to FIG. 2, a system 200 includes a first MEMS device 202 (including a first diaphragm 206 and a first back or charge plate 208) and a second MEMS device 204 (including a second diaphragm 210 and a second back or charge plate 212). The output of the MEMS devices 202 and 204 are supplied to a first integrated circuit 214 and a second integrated circuit 216. The integrated circuits, can in one example be application specific integrated circuits (ASICS). These circuits perform various processing functions such as amplification of the received signals.

The integrated circuits 214 and 216 include a first preamp circuit 218 and a second preamp circuit 220. The purpose of the preamp circuits 214 and 216 is to provide an extremely high impedance interface for a capacitive transducer which is generally high impedance in the bandwidth of interest. A difference between the circuits 214 and 216 is in regard to the diaphragm/back plate orientation (i.e., one circuit 214 or 216 is "upside down," thus causing 180 degree phase shift without negative bias).

The outputs of the circuits 214 and 216 are transmitted to an external differential stage 222 (that includes a difference summer 224 that takes the difference of two signals from the circuits 214 and 216).

A positive potential is supplied to the first diaphragm 206. A positive potential is applied to the second back plate 212. This creates a differential signal at leads 226 and 228 as illustrated in graphs 250 and 252. Here, the second diaphragm and second back plate are flipped mechanically as compared to the example shown in FIG. 1. This creates signals that are 180 degrees out of phase with respect to each other. An output 230 of stage 222 is the difference between signals 227 and 229 and is shown in graph 254.

Common mode noise of the whole system is rejected by the stage 222. Common mode noise occurs between both of the MEMS motors and both ASICs in the example of FIG. 2. As can be seen in the graphs, an increased SNR is achieved at the output 230 and as mentioned, common mode noise is significantly reduced or eliminated. Both of these aspects provide for improved system performance. Common mode noise is significantly reduced or eliminated in the example of FIG. 1 because the common noise components are subtracted from one another. Because they have 0 degree phase difference, the differential amplifier will reject some or all of the common mode signal.

Figure 3:
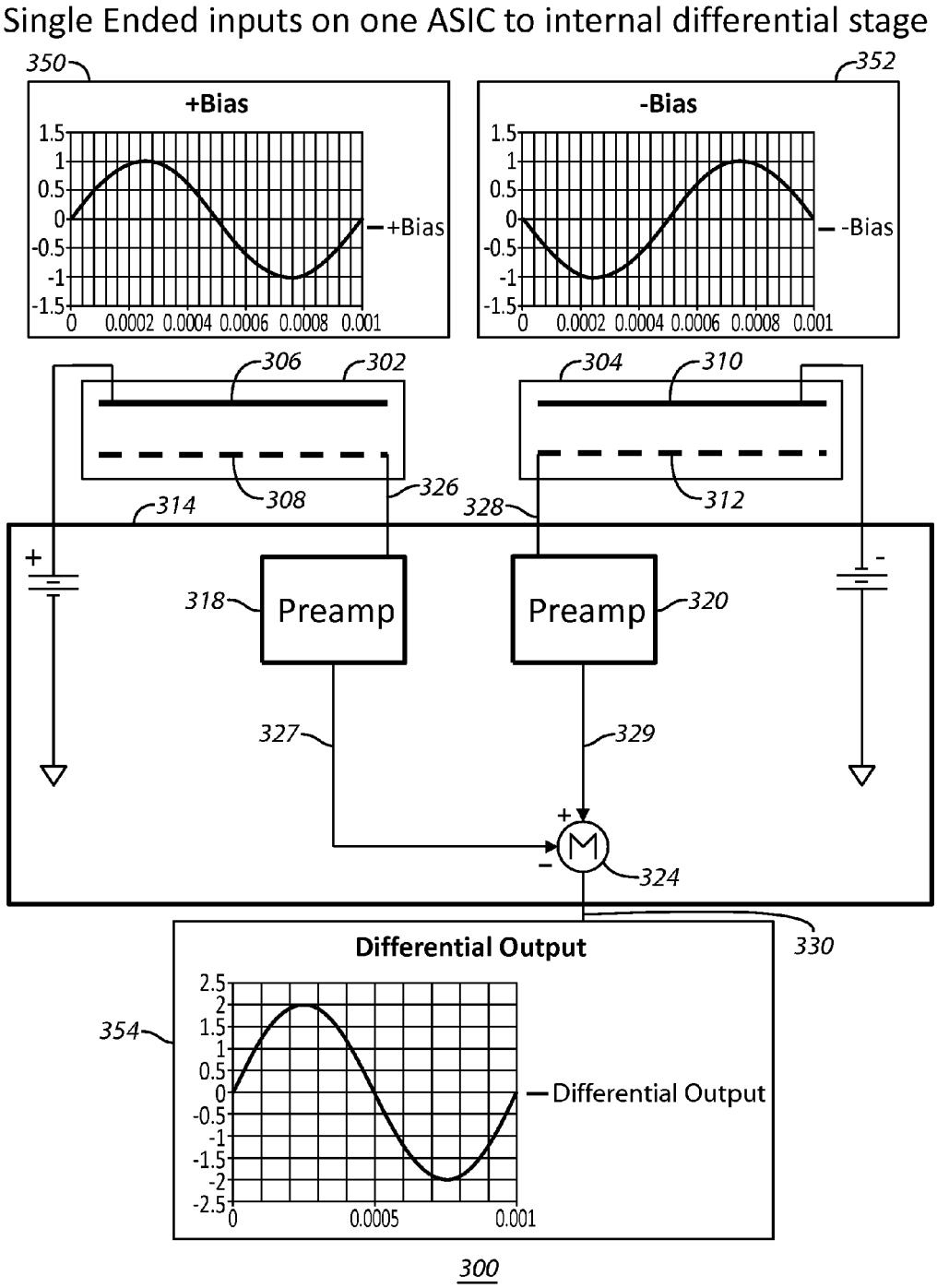
FIG. 3 comprises a block diagram of a system that has single ended inputs in a single chip to internal differential stage according to various embodiments of the present invention.

Referring now to FIG. 3, a system 300 includes a first MEMS device 302 (including a first diaphragm 306 and a first back or charge plate 308) and a second MEMS device 304 (including a second diaphragm 310 and a second back or charge plate 312). The output of the MEMS devices 302 and 304 are supplied to an integrated circuit 314. The integrated circuit, can in one example be application specific integrated circuit (ASIC). These circuits perform various processing functions such as amplification of the received signals.

The integrated circuit 314 includes a first preamp circuit 318 and a second preamp circuit 320. The purpose of the preamp circuits 318 and 320 is to provide an extremely high impedance interface for a capacitive transducer which is generally high impedance in the bandwidth of interest.

The outputs of the preamps 318 and 320 are transmitted to a difference summer 324 that takes the difference of two signals from the preamps.

A positive potential is supplied to first diaphragm 306. A negative potential is applied to the second diaphragm 310. This creates a differential signal at leads 326 and 328 as illustrated in graphs 350 and 352. An output 330 of ASIC 314 is the difference between signals 327 and 329 and is shown in graph 354.

Common mode noise of the system in FIG. 3 is rejected by the summer 354. Common mode noise occurs between the two MEMS motors in the example of FIG. 3. As can be seen in the graphs, an increased SNR is achieved at the output 330 and as mentioned, common mode noise is significantly reduced or eliminated. Both of these aspects provide for improved system performance. Common mode noise is significantly reduced or eliminated in the example of FIG. 1 because the common noise components are subtracted from one another. Because they have 0 degree phase difference, the differential amplifier will reject some or all of the common mode signal.

Figure 4:
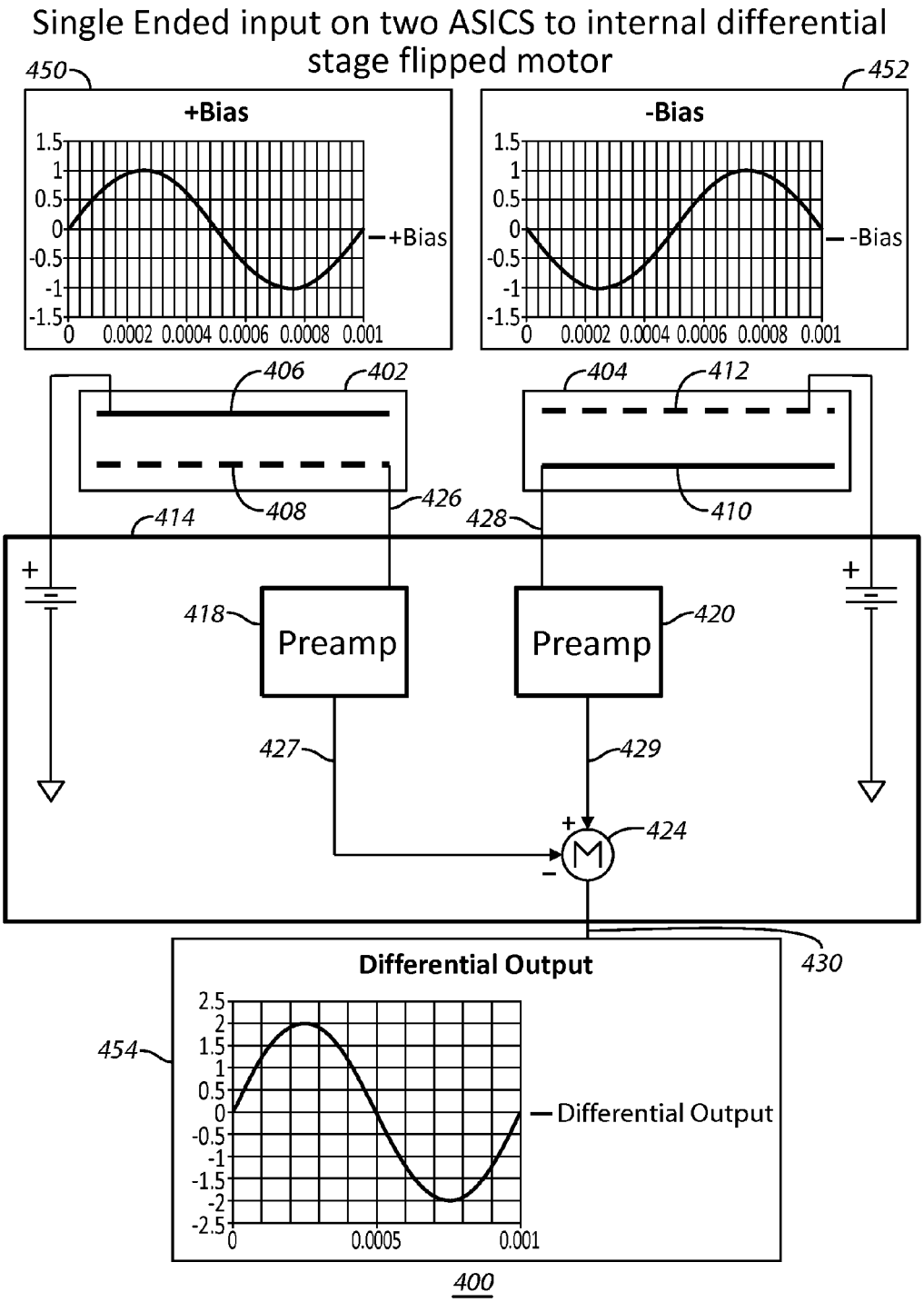
FIG. 4 comprises a block diagram of a system with single ended inputs to one ASIC to internal differential stage flipped motor according to various embodiments of the present invention.

Referring now to FIG. 4, a system 400 includes a first MEMS device 402 (including a first diaphragm 406 and a first back or charge plate 408) and a second MEMS device 404 (including a second diaphragm 410 and a second back or charge plate 412). The output of the MEMS devices 402 and 404 are supplied to an integrated circuit 414. The integrated circuit, can in one example be an application specific integrated circuits (ASIC). The integrated circuit can perform various functions such as signal amplification.

The integrated circuits 414 include a first preamp circuit 418 and a second preamp circuit 420. The purpose of the preamp circuits is to provide an extremely high impedance interface for a capacitive transducer which is generally high impedance in the bandwidth of interest. The outputs of the circuits 414 that takes the difference of two signals from the preamps 414 and 418.

A positive potential is supplied to first diaphragm 406. A positive potential is applied to the second back plate 412. This creates a differential signal at leads 426 and 428 as illustrated in graphs 450 and 452. An output 430 of ASIC 414 is the difference between signals 427 and 429 and is shown in graph 454.

Common mode noise of system of FIG. 4 is rejected by the ASIC 414. Common mode noise occurs between the two MEMS motors in the example of FIG. 4. As can be seen in the graphs, an increased SNR is achieved at the output 430 and as mentioned, common mode noise is significantly reduced or eliminated. Both of these aspects provide for improved system performance. Common mode noise is significantly reduced or eliminated in the example of FIG. 1 because the common noise components are subtracted from one another. Because they have 0 degree phase difference, the differential amplifier will reject some or all of the common mode signal.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An acoustic apparatus, comprising:

a first MEMS motor including a first diaphragm and a first back plate, the first motor configured to create a first differential signal representative of sound energy, wherein a first positive potential is applied to the first diaphragm;

a second MEMS motor including a second diaphragm and a second back plate, the second motor configured to create a second differential signal representative of the sound energy, wherein the second diaphragm and the second back plate are flipped mechanically compared to the first diaphragm and the first back plate, and wherein a second positive potential is applied to the second back plate;

a first preamplifier circuit coupled to the first MEMS motor, the first preamplifier circuit configured to produce a first pre-amplified signal from the first differential signal;

a second preamplifier circuit coupled to the second MEMS motor, the second preamplifier circuit configured to produce a second pre-amplified signal from the second differential signal; and a differential stage coupled to the first preamplifier circuit and the second preamplifier circuit, the differential stage configured to obtain a difference between the first pre-amplified signal and the second pre-amplified signal, wherein the differential stage is disposed on an integrated chip that is different from one or more other integrated chips that include the first preamplifier circuit and the second preamplifier circuit, wherein a first differential bias voltage is created between the first diaphragm and the first back plate to create the first differential signal and a second differential voltage is created between the second diaphragm and the second back plate to create the second differential signal, and wherein common mode noise between the first motor and the second motor is rejected by the differential stage.

2. The apparatus of claim 1, wherein the first preamplifier and the second preamplifier are disposed on separate integrated chips.

3. The apparatus of claim 1, wherein the first preamplifier and the second preamplifier are disposed on the same integrated chip.

4. The acoustic apparatus of claim 1, wherein common mode noise between the first MEMS motor and the second MEMS motor is approximately 0 degrees out of phase.

5. The acoustic apparatus of claim 1, wherein the first differential signal and the second differential signal are approximately 180 degrees out of phase.

6. A method of operating an acoustic apparatus, the acoustic apparatus comprising a first MEMS motor including a first diaphragm and a first back plate, and a second MEMS motor including a second diaphragm and a second back plate, the method comprising:

applying a first positive potential to the first diaphragm;

applying a second positive potential to the second back plate, wherein the second diaphragm and the second back plate are flipped mechanically compared to the first diaphragm and the first back plate;

at the first MEMS motor, creating a first signal representative of received sound energy;

at the second MEMS motor, creating a second signal representative of the received sound energy; and obtaining a differential output signal representative of the difference between the first signal and the second signal, wherein in obtaining the differential output signal common mode noise between the first MEMS motor and the second MEMS motor is rejected wherein the first MEMS motor is mechanically inverted with respect to the second MEMS motor to create an 180 degree phase shift between the first signal and the second signal.

7. The method of claim 6, wherein common mode noise between the first motor and the second motor is approximately 0 degrees out of phase.

8. The method of claim 6, wherein the approximate 180 degree phase shift is achieved without negative bias.

9. An acoustic apparatus comprising:

a first MEMS motor including a first diaphragm and a first back plate, the first motor configured to create a first differential signal representative of sound energy, wherein a first positive potential is applied to the first diaphragm;

a second MEMS motor including a second diaphragm and a second back plate, the second motor configured to create a second differential signal representative of sound energy, wherein the second diaphragm and the second back plate are flipped mechanically compared to the first diaphragm and the first back plate, wherein a second positive potential is applied to the second back plate;

a first preamplifier circuit coupled to the first motor, the first preamplifier circuit configured to produce a first pre-amplified signal from the first differential signal;

a second preamplifier circuit coupled to the second motor, the second preamplifier circuit configured to produce a second pre-amplified signal from the second differential signal; and a differential stage coupled to the first preamplifier circuit and the second preamplifier circuit, the differential stage configured to obtain a difference between the first pre-amplified signal and the second pre-amplified signal, wherein the differential stage is disposed on an integrated chip that is different from one or more other integrated chips that include the first preamplifier circuit and the second preamplifier circuit, wherein a first differential bias voltage is created between the first diaphragm and the first back plate to create the first differential signal and a second differential voltage is created between the second diaphragm and the second back plate to create the second differential signal and wherein common mode noise between the first motor and the second motor is rejected by the differential stage.

10. The acoustic apparatus of claim 9, wherein the first preamplifier and the second preamplifier are disposed on a single integrated chip.

11. The acoustic apparatus of claim 9, wherein the first preamplifier and the second preamplifier are disposed on separate integrated chips.

12. The acoustic apparatus of claim 9, wherein the common mode noise between the first MEMS motor and the second MEMS motor is approximately 0 degrees out of phase.

13. The acoustic apparatus of claim 9, wherein the first differential signal and the second differential signal are approximately 180 degrees out of phase.

* * * * *